US011326567B2

(12) United States Patent
Pintilie

(10) Patent No.: US 11,326,567 B2
(45) Date of Patent: May 10, 2022

(54) METHOD AND ASSEMBLY FOR DELIVERING FUEL IN A FUEL TANK

(71) Applicant: TI AUTOMOTIVE TECHNOLOGY CENTER GMBH, Rastatt (DE)

(72) Inventor: Radu-Paul Pintilie, Karlsruhe (DE)

(73) Assignee: TI AUTOMOTIVE TECHNOLOGY CENTER GMBH, Rastatt (DE)

( * ) Notice: Subject to any disclaimer, the term of this patent is extended or adjusted under 35 U.S.C. 154(b) by 47 days.

(21) Appl. No.: 16/609,109

(22) PCT Filed: Apr. 26, 2018

(86) PCT No.: PCT/IB2018/052917

§ 371 (c)(1),
(2) Date: Oct. 28, 2019

(87) PCT Pub. No.: WO2018/198075

PCT Pub. Date: Nov. 1, 2018

(65) Prior Publication Data

US 2020/0200131 A1 Jun. 25, 2020

(30) Foreign Application Priority Data

Apr. 28, 2017 (DE) ..... 102017109274.9

(51) Int. Cl.
*F02M 37/00* (2006.01)
*F02M 37/02* (2006.01)

(52) U.S. Cl.
CPC .... *F02M 37/0094* (2013.01); *F02M 37/0023* (2013.01); *F02M 37/0082* (2013.01); *F02M 37/025* (2013.01)

(58) Field of Classification Search
CPC ..... F02M 37/0094; F02M 37/0023; F02M 37/0082; F02M 37/025; F02M 347/106
See application file for complete search history.

(56) References Cited

U.S. PATENT DOCUMENTS 5,197,444 A 3/1993 Lang et al.
9,528,478 B2 12/2016 Park et al.
(Continued)

FOREIGN PATENT DOCUMENTS

CN 110626163 A 12/2019
DE 40 27 948 A1 3/1992
(Continued)

OTHER PUBLICATIONS

Translation of DE102008054380 (Year: 2021).*
International Search Report and Written Opinion dated Jun. 14, 2018.

*Primary Examiner* — Kelsey E Cary
(74) *Attorney, Agent, or Firm* — Dickinson Wright PLLC; Michael N. Spink; Sungwook Lee

(57) ABSTRACT

The present disclosure is related to a method and an assembly for delivering fuel in a fuel tank (10), wherein the fuel tank comprises at least a first chamber (12) having a module pot (18) disposed therein and at least a first pump (30) adapted to deliver fuel from the first chamber to the module pot, and wherein a fuel pump (20) for delivering fuel to an engine is disposed within the module pot. In order to minimize the duty cycle of the pumps and therefore the energy consumption, it is proposed according to the present disclosure that a sensor device (22) is used to detect a predetermined minimum fill level in the module pot, wherein the pump disposed in the first chamber is activated when the minimum fill level is reached and is deactivated after a predetermined time interval or when a predetermined higher fill level in the module pot is reached.

13 Claims, 3 Drawing Sheets

(56) References Cited

U.S. PATENT DOCUMENTS

| | | | | |
|---|---|---|---|---|
| 10,451,013 | B2 | 10/2019 | Pursifull et al. | |
| 2004/0237941 | A1* | 12/2004 | Sinz | F02M 37/18 123/509 |
| 2005/0051141 | A1 | 3/2005 | Rumpf | |
| 2007/0266762 | A1* | 11/2007 | Rumpf | F02M 37/025 73/1.73 |
| 2008/0142097 | A1* | 6/2008 | Rumpf | F02M 37/106 137/565.23 |
| 2013/0248027 | A1* | 9/2013 | Gutscher | F02M 37/025 137/565.11 |
| 2014/0014073 | A1 | 1/2014 | Scholz et al. | |
| 2015/0369259 | A1 | 12/2015 | Park et al. | |
| 2017/0051701 | A1 | 2/2017 | Pursifull et al. | |

FOREIGN PATENT DOCUMENTS

| | | | |
|---|---|---|---|
| DE | 10342081 | A1 | 4/2005 |
| DE | 10 2008 054380 | A1 | 6/2010 |
| DE | 102008054380 | A1 | 6/2010 |
| JP | 2006161700 | A | 6/2006 |
| JP | 2007032460 | A | 2/2007 |
| JP | 2007218222 | A | 8/2007 |
| JP | 2008531908 | A | 8/2008 |
| JP | 2013068107 | A | 4/2013 |

* cited by examiner

METHOD AND ASSEMBLY FOR DELIVERING FUEL IN A FUEL TANK

CROSS-REFERENCE TO RELATED APPLICATIONS

This application is a 35 U.S.C. § 371 national phase application of International Application No. PCT/IB2018/052917, filed Apr. 26, 2018, which claims the benefit of priority to German Patent Application No. 10 2017 109 274.9, filed Apr. 28, 2017, the contents of which are incorporated herein by reference in their entirety.

RELATED APPLICATIONS

The present patent document claims the benefit of priority to German Patent Application 10 2017 109 274.9, filed Apr. 28, 2017, and entitled "Method And Assembly For Delivering Fuel In A Fuel Tank", the entire contents of each of which are incorporated herein by reference.

FIELD

The present disclosure is related to a method and an assembly for delivering fuel in a fuel tank, wherein the fuel tank comprises at least a first chamber having a module pot disposed therein and at least a first pump adapted to deliver fuel from the first chamber to the module pot, and wherein a fuel pump for delivering fuel to an engine is disposed within the module pot.

BACKGROUND

The module pot constitutes a volume which is separated by a pot wall from the remaining interior volume of the tank, so that fuel delivered to the engine by the fuel pump located in the module pot must be replenished from the remaining interior volume of the tank. This is done, for example, by the use of a suction jet pump which is operated by a partial flow diverted from a fuel line leading to the exterior of the tank. In the case of a saddle tank having two chambers which are partially separated from each other by the saddle, wherein the module pot is located in the first of the two chambers, fuel must be transported by a pump, usually a suction jet pump, from the second chamber to the first chamber when the fill level in the second chamber falls below the height of the saddle separating the two chambers from each other. Also in the case of a saddle tank fuel is transported by a further pump from the first chamber into the module pot. It is customary to operate the pump or the multiple pumps continuously, even if this would not be necessary by system demands, such as the fill levels in the first and second chamber and the module pot. The continuous operation unnecessarily wastes energy.

BRIEF SUMMARY

The present disclosure provides a fuel delivery assembly and method that optimizes the energy usage for the operation of the pumps in the fuel tank.

For the solution of this object the combinations of features of claims 1 and 7 are proposed. Advantageous embodiments and further developments result from the dependent claims.

The present disclosure teaches that by monitoring the relevant parameters an intelligent pump control can be implemented. According to the present disclosure, a sensor device is used to detect a predetermined minimum fill level in the module pot, wherein the pump disposed in the first chamber is activated when the minimum fill level is reached and is deactivated after a predetermined time interval or when a predetermined higher fill level in the module pot is reached. In particular, the sensor device may comprise a first sensor with which a predetermined maximum fill level in the module pot, at which the first pump is deactivated, is detected, and a second sensor with which the predetermined minimum fill level in the module pot is detected.

According to a preferred embodiment of the present disclosure the fuel tank is a saddle tank and has a second chamber with at least one second pump for delivering fuel from the second chamber to the first chamber disposed therein, and to further reduce the energy usage a third sensor is disposed in the second chamber for detecting a predetermined minimum fill level in this chamber, wherein the pump disposed in the second chamber is deactivated in response to the third sensor when the predetermined minimum fill level is reached.

Preferably the first and/or the second pump is a suction jet pump and a partial flow is diverted from the fuel pump located in the module pot to operate the first and/or second suction jet pump.

Since the suction jet pumps are operated by a partial flow diverted from the fuel pump, the activation and deactivation of the suction jet pumps may advantageously be effected by controlling at least one valve disposed in the feed line to the first and/or second suction jet pump. According to a further development of the present disclosure a first valve is located in a feed line for the operation of the first and/or second suction jet pump, which opens to allow the operation of at least the first suction jet pump when the sensor device is the module pot detects the predetermined minimum fill level, and which closes to stop the operation of at least the first suction jet pump when the sensor device in the module pot detects the predetermined maximum fill level. Correspondingly, a second valve may be located in the feed line for the operation of the first and/or second suction jet pump, which second valve closes to stop the operation of the second suction jet pump when the third sensor detects the predetermined minimum fill level in the second chamber.

BRIEF DESCRIPTION OF THE DRAWINGS

In the following the present disclosure will be described with reference to embodiments schematically shown in the drawing, in which.

DETAILED DESCRIPTION

Figure 1:
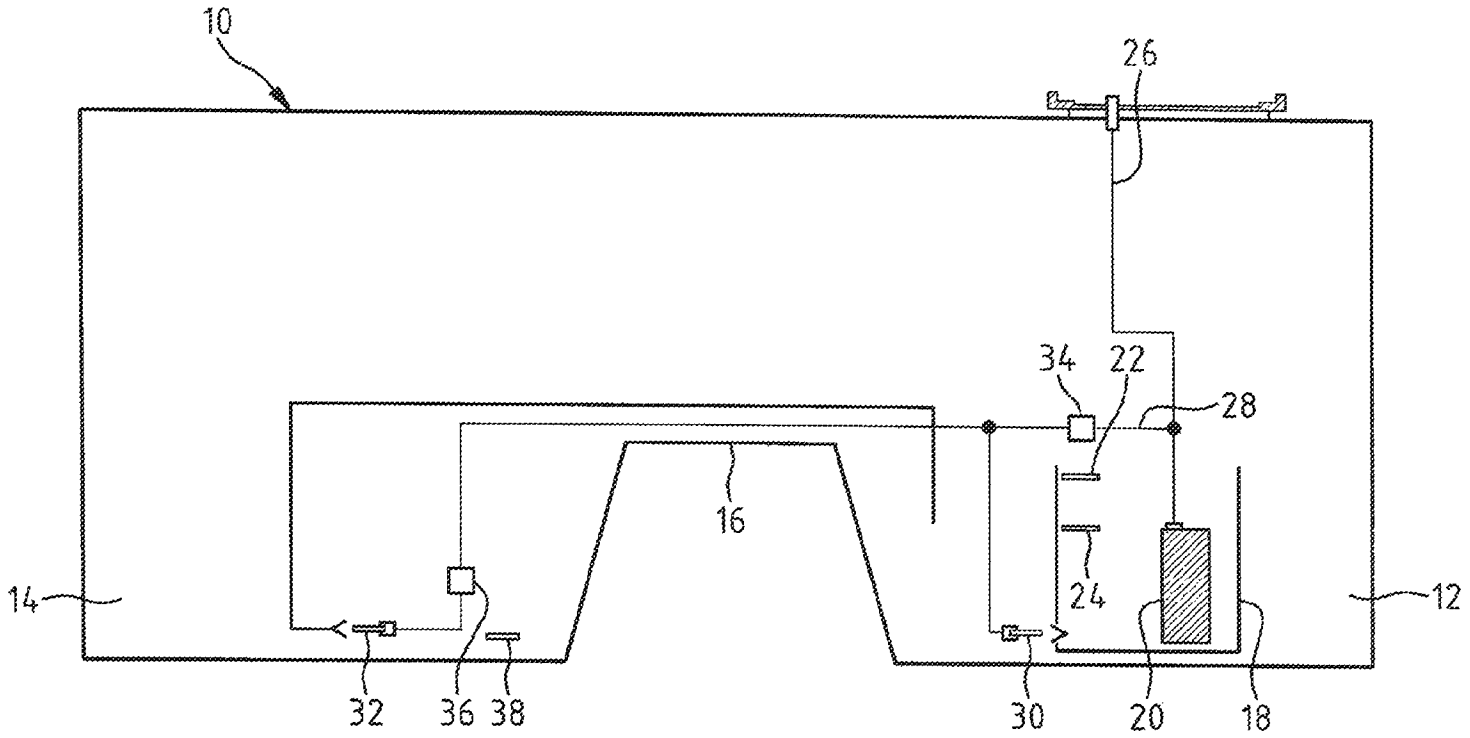
FIG. 1 is a schematic side view of a saddle tank comprising a module pot, sensors and pumps.

The saddle tank 10 schematically shown in FIG. 1 comprises a first chamber 12 and a second chamber 14, the volumes of which are partially separated from each other by a saddle 16. A module pot 18 is disposed in the first chamber 12, which contains a fuel pump 20 and which forms a reservoir for fuel. The module pot 18 further contains a first sensor 22 for detecting a predetermined maximum fill level and a second sensor 24 for detecting a predetermined minimum fill level. A fuel line 26 leads from the fuel pump 20 to a motor (not shown), and a feed line 28 for the operation of suction jet pumps is diverted from the fuel line 26. A first suction jet pump 30 is located in the first chamber 12 and delivers fuel from this chamber to the module pot 18. A second suction jet pump 32 is located in the second chamber 14 and delivers fuel from this chamber to the first chamber 12. A first valve 34 and a second valve 36 are located in the feed line 28. The first valve 34 controls the flow to the two suction jet pumps 30, 32, while the second valve 36 controls the flow only to the second suction jet pump 32. Further, a third sensor 38 for detecting a predetermined minimum fill level or for detecting a state in which the suction side of the second suction jet pump cannot pick up fuel due, for example, to lateral acceleration or tilting of the saddle tank is located in the second chamber 14. Further, there is provided an electronic control unit (not shown) which receives the various sensor signals and controls the valves 30, 32 to open and shut off, as will be described below with reference to an operational diagram.

Figure 2:
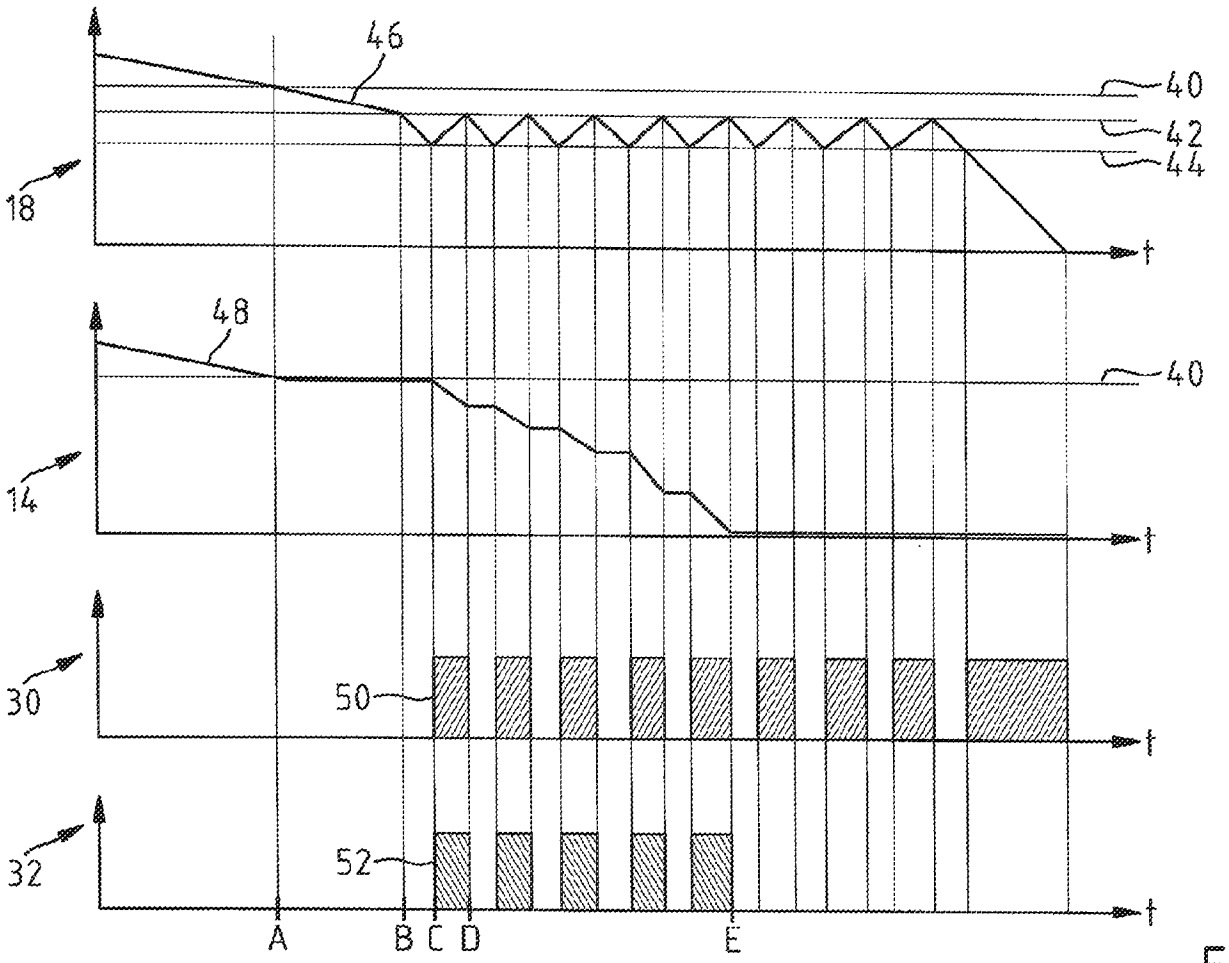
FIG. 2 is a diagram of the pump operation and the fill levels in the tank.

The operation of the delivery control to optimize the energy usage will be described with reference to the diagram of FIG. 2, which traces the fill levels in the module pot 18 and in the second chamber 14 as well as the operating cycles of the suction jet pumps 30, 32 as a function of time t.

In the upper portion of the diagram a saddle height 40 and maximum and minimum fill levels 42, 44 corresponding to the first and second sensor 22, 24 are shown as horizontal lines. The progress of the fill level in the module pot 18 as the total fuel content of the saddle tank 10 is gradually consumed is represented by the line 46. When the module pot 18 is fully filled while the fill level in the saddle tank 10 exceeds the upwardly open module pot 18 as well as the saddle 16, the operation of neither the first nor the second suction jet pump is necessary, and the valves 34, 36 are shut off.

At the point in time A the fill level in the saddle tank 10 falls below the height of the saddle 16. The fill level in the second chamber 14, the fuel content of which now cannot flow freely into the first chamber 12 anymore, is represented by the line 48. At the point in time B the fill level in the module pot 18 reaches the level of the first sensor 22 and then progressively falls to the level of the second sensor 24 at the point in time C. At this point in time C the electronic control unit opens the valves 34, 36 and both suction jet pumps 30, 32 begin to operate, so that on the one hand fuel is delivered into the module pot 18 by means of the first suction jet pump 30, and on the other hand fuel is delivered from the second chamber 14 to the first chamber 12. The operation of the suction jet pumps 30 and 32 is represented by shaded blocks 50 and 52, respectively. Both suction jet pumps continue to operate until a fill level at the level of the first sensor 22 is reached in the module pot 18 at the point in time D. The valves 34, 36 are then shut off and the suction jet pumps are made inoperable. This opening and shutting-off of the valves 34, 36 in response to the sensors 22, 24 continues in the described manner until the point in time E is reached. At the point in time E the third sensor 38 in the second chamber 14 detects that the minimum predetermined fill level has been reached. A further operation of the second suction jet pump 32 would be ineffective. The electronic control unit therefore shuts off the second valve 36 in response to the third sensor 38 signal until the next refueling event.

From the point in time E on, fuel is present only in the first chamber 12 and in the module pot 18. The operation of the first suction jet pump 30 continues as described above in response to the sensors 22, 24, until the fuel content of the first chamber 12 has been exhausted. During this time the electronic control unit operates only the first valve 34 to open and shut off. Finally, only the reserve volume of fuel in the module pot 18 remains, until the next refueling event.

The control and operation of the suction jet pumps 30, 32 in response to the three sensors 22, 24, 38 as described above effectively minimizes the operational energy provided by the fuel pump 20.

Figure 3:
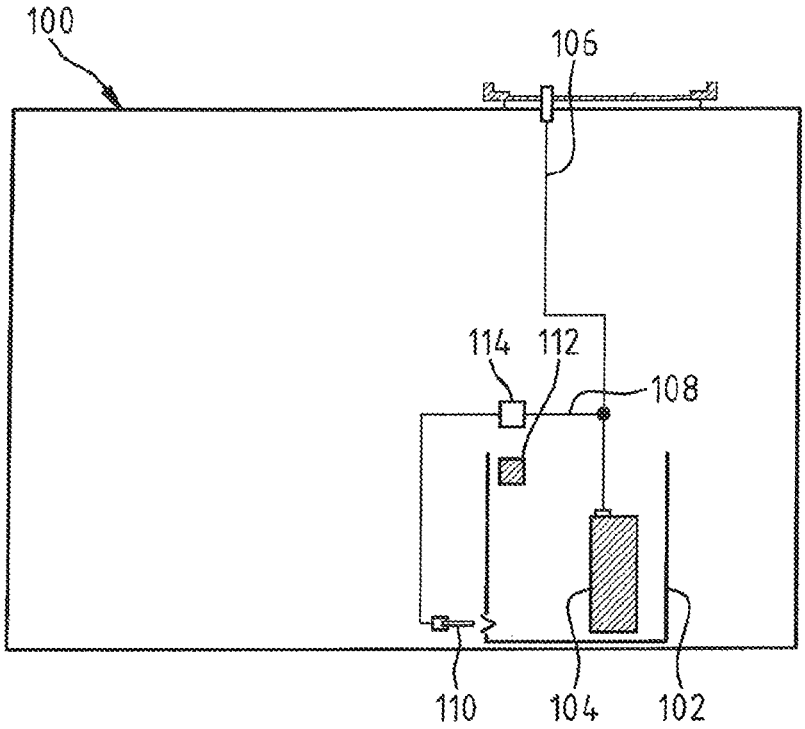
FIG. 3 is a schematic side view of a single chamber tank comprising a module pot, sensors and pumps.

FIG. 3 shows a single chamber tank 100 comprising a module pot 102 having a fuel pump 104 disposed therein and a fuel line 106 leading from the fuel pump to a vehicle engine, from which fuel line a feed line 108 for the operation of a suction jet pump 110 is diverted. In the module pot 102 a sensor device 112 designed as a piezo fill level meter is provided as an alternative to the two sensors 22, 24 shown in FIG. 1, by means of which predetermined minimum and maximum fill levels are detected, in response to which the suction jet pump 110 is activated or deactivated. When reaching the predetermined minimum fill level an electronic control unit (not shown), in which the predetermined operating parameters are also stored, opens a valve 114 located in the feed line 108 to operate the suction jet pump 110, which then delivers fuel to the module pot 102 until the predetermined maximum fill level is reached. The valve 114 is then shut off by means of the electronic control unit and the delivery of fuel to the module pot is stopped, until the minimum fill level is reached once again. It is also possible to monitor only the minimum fill level in the module pot 102 and to operate the suction jet pump 110 for a predetermined time interval when reaching this minimum fill level. When the delivery rate of the suction jet pump 110 is known, the time until the desired maximum fill level in the module pot 102 is reached can be calculated.

In summary the following may be stated: The present disclosure relates to a method and an assembly for delivering fuel in a fuel tank 10, 100, wherein the fuel tank 10, 100 comprises at least a first chamber 12 having a module pot 18, 102 disposed therein and at least a first pump 30, 110 adapted to deliver fuel from the first chamber 12 to the module pot 18, 102, and wherein a fuel pump 20, 104 for delivering fuel to an engine is disposed within the module pot 18, 102. In order to minimize the duty cycle of the pumps and therefore the energy consumption, it is proposed according to the present disclosure that a sensor device 22, 24, 112 is used to detect a predetermined minimum fill level in the module pot 18, 102, wherein the pump 30, 110 disposed in the first chamber 12 is activated when the minimum fill level is reached and is deactivated after a predetermined time interval or when a predetermined higher fill level in the module pot 18, 102 is reached.

The invention claimed is:

1. A method for delivering fuel in a fuel tank, wherein the fuel tank is a saddle tank having at least a first chamber and a second chamber, the first chamber having a module pot disposed therein and at least a first pump adapted to deliver fuel from the first chamber to the module pot, and wherein a fuel pump for delivering fuel to an engine is disposed within the module pot, the second chamber having at least one second pump disposed therein for delivering fuel from the second chamber to the first chamber, wherein a first valve is located in a common feed line for the operation of the first pump and a second valve is located in the common feed line for the operation of the second pump such that the first valve is located between the fuel pump and the second valve on the common feed line, and a sensor device is disposed in the first chamber to detect a predetermined minimum fill level in the module pot, wherein the first pump disposed in the first chamber is activated when the sensor device detects the minimum fill level is reached and is deactivated after a predetermined time interval or when a predetermined maximum fill level in the module pot is reached, and a third sensor is disposed in the second chamber for detecting a predetermined minimum fill level in the second chamber, wherein the second pump disposed in the second chamber is deactivated in response to the third sensor detecting when the predetermined minimum fill level is reached.

2. The method of claim 1, wherein the sensor device comprises a first sensor with which a predetermined maximum fill level in the module pot, at which the first pump is deactivated, is detected, and a second sensor with which the predetermined minimum fill level in the module pot is detected.

3. The method of claim 1, wherein the first and/or the second pump is a suction jet pump and that a partial flow is diverted from the fuel pump located in the module pot to operate the first and/or second suction jet pump.

4. The method of claim 3, wherein the first valve opens to allow the operation of at least the first suction jet pump when the sensor device is the module pot detects the predetermined minimum fill level, and closes to stop the operation of at least the first suction jet pump when the sensor device in the module pot detects the predetermined maximum fill level.

5. The method of claim 4, wherein the second valve closes to stop the operation of the second suction jet pump when the third sensor detects the predetermined minimum fill level in the second chamber.

6. The assembly of claim 1, wherein the first valve controls the first pump and the second pump.

7. An assembly for delivering fuel in a fuel tank, wherein the fuel tank is a saddle tank having at least a first chamber and a second chamber, the first chamber having a module pot disposed therein and at least a first pump for delivering fuel from the first chamber to the module pot, wherein a fuel pump for delivering fuel to an engine is located in the module pot, the second chamber having at least one second pump disposed therein for delivering fuel from the second chamber to the first chamber, wherein a first valve is located in a common feed line for the operation of the first pump and a second valve is located in the common feed line for the operation of the second pump such that the first valve is located between the fuel pump and the second valve on the common feed line, and a sensor device for detecting at least a predetermined minimum fill level is disposed in the module pot, wherein the first pump located in the first chamber is activated when the sensor device detects the minimum fill level in the module pot is attained and is deactivated after a predetermined time interval or when a predetermined maximum fill level is attained, and a third sensor is disposed in the second chamber for detecting a predetermined minimum fill level in the second chamber, wherein the second pump disposed in the second chamber is deactivated in response to the third sensor detecting when the predetermined minimum fill level is reached.

8. The assembly of claim 7, wherein the sensor device comprises a first sensor which is operable to detect a predetermined maximum fill level in the module pot, at which the first pump is deactivated, and a second sensor which is operable to detect the predetermined minimum fill level in the module pot.

9. The assembly of claim 8, wherein the first and/or second pump is a suction jet pump and that a partial flow is diverted from the fuel pump located in the module pot to operate the first and/or second suction jet pump.

10. The assembly of claim 8, wherein the first valve opens to allow the operation of at least the first suction jet pump when the sensor device is the module pot detects the predetermined minimum fill level, and closes to stop the operation of at least the first suction jet pump when the sensor device in the module pot detects the predetermined maximum fill level.

11. The assembly of claim 10, wherein the second valve closes to stop the operation of the second suction jet pump when the third sensor detects the predetermined minimum fill level in the second chamber.

12. A fuel tank comprising the assembly of claim 8.

13. The assembly of claim 7, wherein the first valve controls the first pump and the second pump.

* * * * *